US010004344B1

(12) United States Patent
Williams

(10) Patent No.: US 10,004,344 B1
(45) Date of Patent: Jun. 26, 2018

(54) PICTURE HANGING HOOK POSITIONING AND MOUNTING DEVICE

(71) Applicant: Rudolph Von Williams, Cape Coral, FL (US)

(72) Inventor: Rudolph Von Williams, Cape Coral, FL (US)

( * ) Notice: Subject to any disclaimer, the term of this patent is extended or adjusted under 35 U.S.C. 154(b) by 0 days. days.

(21) Appl. No.: 15/462,808

(22) Filed: Mar. 18, 2017

(51) Int. Cl.
*A47G 1/20* (2006.01)
*A47G 1/17* (2006.01)

(52) U.S. Cl.
CPC ..... *A47G 1/205* (2013.01); *A47G 1/17* (2013.01)

(58) Field of Classification Search
CPC ..... A47G 1/205; A47G 1/17
USPC ..... 248/214, 216.4, 467, 475.1, 494, 544, 248/547; 33/613, 614, 615; 211/70.6
See application file for complete search history.

(56) References Cited

U.S. PATENT DOCUMENTS 3,599,686 A 8/1971 Peebles
3,945,599 A * 3/1976 Spier ..... A47G 1/202 248/298.1
4,455,756 A * 6/1984 Greene ..... A47G 1/205 248/547
4,637,583 A 1/1987 Babitz
5,520,318 A 5/1996 Sloop
6,049,991 A 4/2000 Gruenberg et al.
6,062,525 A * 5/2000 Lemire ..... A47G 1/164 248/475.1
6,421,928 B1 * 7/2002 Miller ..... A47G 1/205 33/520
6,473,983 B1 * 11/2002 Gier ..... A47G 1/205 33/613
6,739,065 B2 5/2004 Hofmesiter
7,484,311 B2 2/2009 Bommarito
7,673,409 B2 * 3/2010 Pitcher ..... G09F 7/18 248/316.7
8,209,836 B2 7/2012 Klein
8,739,423 B1 * 6/2014 Cortum ..... G01C 9/28 33/374
9,032,637 B2 * 5/2015 Propp ..... B25H 7/04 33/613
D794,979 S * 8/2017 Centracchio ..... D22/147
9,782,023 B2 * 10/2017 Fattahi ..... A47G 1/17
2006/0101661 A1 * 5/2006 Schmidt ..... A47G 1/205 33/613
2008/0000853 A1 * 1/2008 Huang ..... A47F 7/0028 211/70.6
2008/0196262 A1 * 8/2008 Bommarito ..... A47G 1/205 33/613
2009/0218302 A1 * 9/2009 Winnard ..... B25H 3/003 211/70.6

OTHER PUBLICATIONS http://picturehangingpro.com/products Jan. 12, 2015.
http://hangitez.com/how-to-use-the-hang-it-ez/ Jan. 12, 2015.
https://hangitperfect.com/ Jan. 12, 2015.
http://hangomatic.com/ Jan. 12, 2015.
http://www.utrdecorating.com/products/about-hang-and-level/ Jan. 12, 2015.

* cited by examiner

*Primary Examiner* — Muhammad Ijaz
(74) *Attorney, Agent, or Firm* — Edward M. Livingston, Esq.; Bryan L. Loeffler, Esq.; Livingston Loeffler, P.A.

(57) ABSTRACT

A picture hanging hook positioning and mounting device (1) for positioning, leveling, and holding picture hanging hooks while securing the picture hanging hooks to a wall with nails.

10 Claims, 2 Drawing Sheets

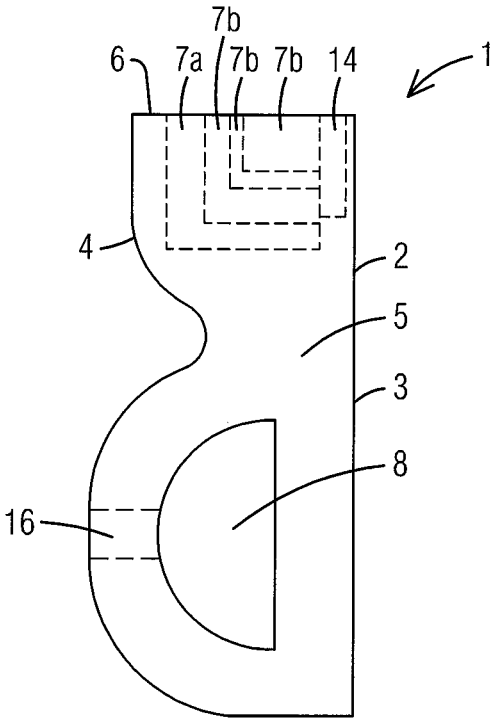
FIG. 1
FIG. 2
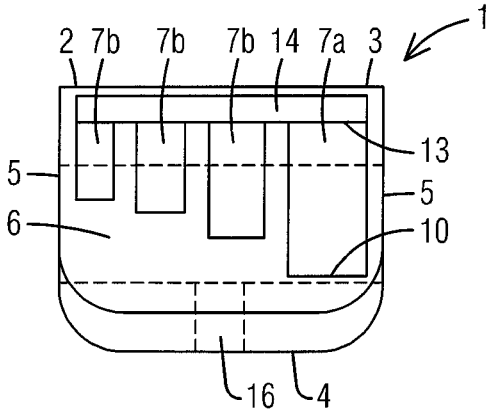
FIG. 3
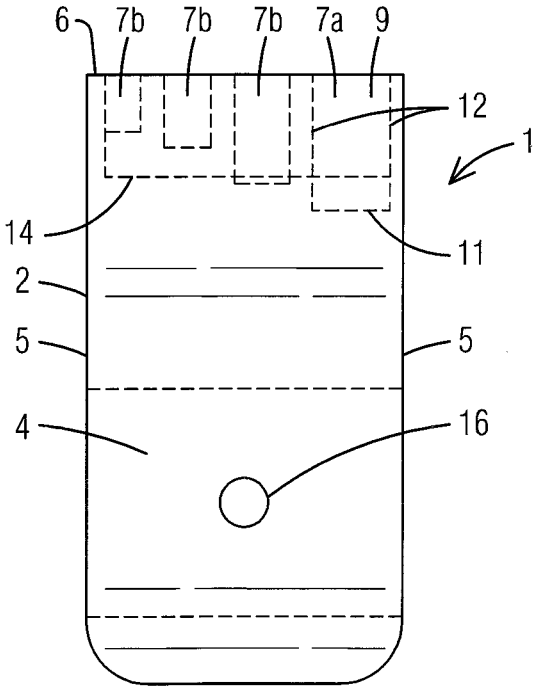

PICTURE HANGING HOOK POSITIONING AND MOUNTING DEVICE

FIELD OF THE INVENTION

This invention relates to hanging pictures and artwork on walls and more particularly a device used for positioning one or more hanger hooks on a wall and holding the one or more hooks in position until mounted to the wall.

BACKGROUND OF THE INVENTION

It is well recognized that the positioning of hanger hooks on the surface of a wall is a difficult and time consuming procedure. The difficulty arises in first, positioning hanger hooks at a desired height on the wall, second, leveling the hooks, and third, holding the hanger hooks in positions while hammering nails through angled aperture on the hanger hooks and into the surface of the wall.

The shape of conventional hanger hooks and the angle of the apertures located thereon make these tasks especially difficult when attempting to do so by holding the hanging hooks in position with only an individual's fingers.

Therefore, a need exists for a device used for positioning one or more hooks on a wall and holding the one or more hooks in a level position until they can be mounted to the wall.

The relevant prior art includes the following references:

| Pat. No. | Inventor | Issue/Publication Date |
|---|---|---|
| | (U.S. Patent References) | |
| 3,599,686 | Peebles | Aug. 17, 1971 |
| 4,455,756 | Greene | Jun. 26, 1984 |
| 4,637,583 | Babitz | Jan. 20, 1987 |
| 5,520,318 | Sloop | May 28, 1996 |
| 6,049,991 | Gruenberg et al. | Apr. 18, 2000 |
| 6,739,065 | Hofmesiter | May 25, 2004 |
| 7,484,311 | Bommarito | Feb 3, 2009 |
| 8,209,836 | Klein | Jul. 3, 2012 |
| | (Non-Patent Literature) | |
| http://picturehangingpro.com/products | | Jan. 12, 2015 |
| http://hangitez.com/how-to-use-the-hang-it-ez/ | | Jan. 12, 2015 |
| https://hangitperfect.com/ | | Jan. 12, 2015 |
| http://hangomatic.com/ | | Jan. 12, 2015 |
| http://www.utrdecorating.com/products/about-hang-and-level/ | | Jan. 12, 2015 |

SUMMARY OF THE INVENTION

The primary object of the present invention is to provide a device used for positioning one or more hooks on a wall, leveling those hooks, and holding the one or more hooks in position until a photo or artwork can be mounted to the wall.

The present invention fulfills the above and other objects by providing a device for positioning, leveling, and holding picture hanging hooks while securing the picture hanging hooks to a wall with nails. The device has a cross arm that is preferably clear and has ruler markings located thereon for measuring the distance between two sliding holding bodies. The holding bodies are substantially rectangular shaped having various shaped recessed slots located on an upper panel to accommodate different sized hanging hooks. The holding bodies may be used individually to hang single hanging hooks or together with the cross arm to hang multiple hanging hooks for larger wall hangings. These hooks are more easily retained in place with magnets that are within the recessed slots.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which:

FIG. 1 is a side plan view of a picture hanging hook positioning and mounting device of the present invention;

FIG. 2 is a top plan view of a picture hanging hook positioning and mounting device of the present invention;

FIG. 3 is a front plan view of a picture hanging hook positioning and mounting device of the present invention;

DESCRIPTION OF THE PREFERRED EMBODIMENTS

Figure 4:
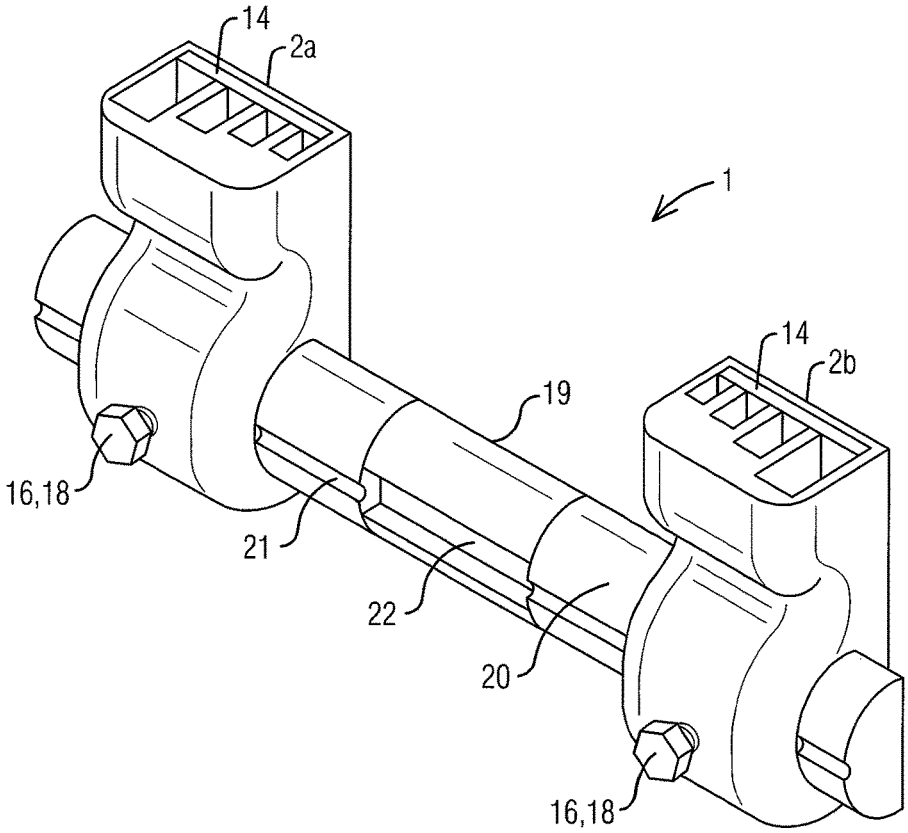
FIG. 4 is a top perspective view of a picture hanging hook positioning and mounting device of the present invention having a first holding body and second holding body attached to a cross member.

For purposes of describing the preferred embodiment, the terminology used in reference to the numbered accessories in the drawings is as follows:

1. hanging hook positioning and mounting device, generally
2. holding body
2*a*. first holding body
2*b*. second holding body
3. rear panel of holding body
4. front panel of holding body
5. side panel of holding body
6. top panel of holding body
7. recessed slot
7*a*. first recessed slot
7*b*. subsequent recessed slot
8. cross arm aperture
9. opening of recessed slot
10. front wall of recessed slot
11. bottom panel of recessed slot
12. side wall of recessed slot
13. rear wall of recessed slot
14. magnet
15. cross arm
16. locking means
17. threaded aperture
18. bolt
19. rear surface of cross arm
20. front surface of cross arm
21. groove
22. bubble level
23. ruler marking With reference to FIGS. 1-3, a picture hanging hook positioning and mounting device 1 of the present invention is illustrated. The picture hanging hook positioning and mounting device 1 comprises a holding body 2 having a substantially planar rear panel 3 and a front panel 4 spaced a predetermined distance from the rear panel 3 by side panels 5 and a top panel 6 to allow for an interior space within the holding body that may be hollow or solid to allow for placement of at least one recessed slot 7 and a cross arm aperture 8.

Figure 5:
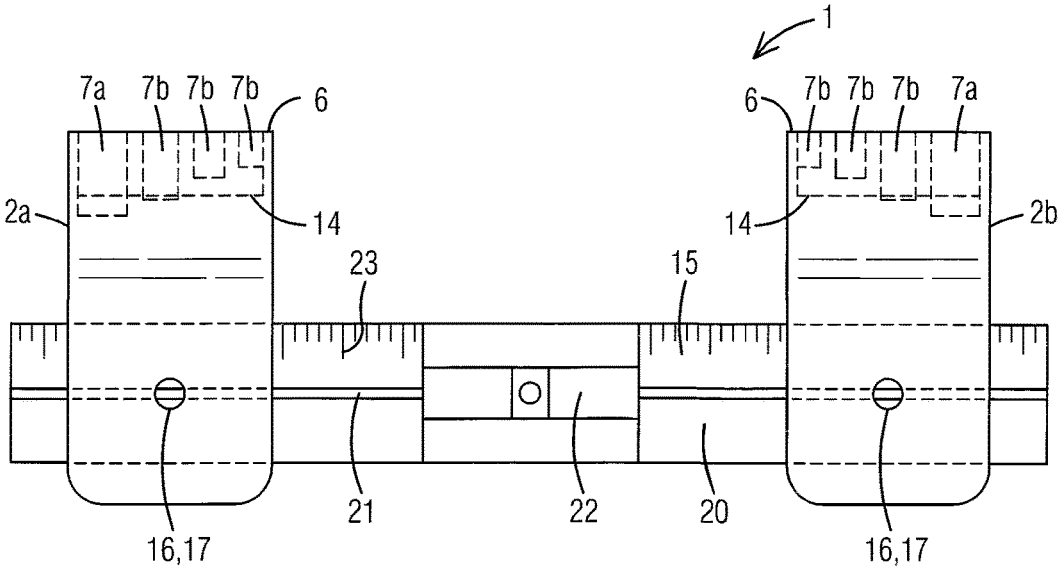
FIG. 5 is a front plan view of a picture hanging hook positioning and mounting device of the present invention having a first holding body and second holding body attached to a cross member.

Each at least one recessed slot 7 comprises an opening 9 located on the top panel 6 that is preferably rectangular-shaped to accommodate the insertion of a hanging hook into the at least one recessed slot 7. Each at least one recessed slot 7 further comprises a front wall 10, a bottom panel 11, two side walls 12 and a rear wall 13 directly adjacent and parallel to the rear panel 3 of the holding body 2. The bottom panel 11 may be angled. As illustrated here, a plurality of recessed slots 7 are located on the top panel 6 and said plurality of recessed slots 7 comprise a first recessed slot 7*a* then one or more progressively smaller subsequent recessed slots 7*b* to allow for different sized hanging hooks to be inserted therein. At least one magnet 14 is also located between the at least one recessed slot 7 and the rear panel 3 of the holding body 2 to further secure hanging hooks within the at least one recessed slot 7 for positioning and mounting said hanging hooks to a wall. The holding body 2 may also comprise a cross arm aperture 8 extending through the side panels 5 of the holding body 2 and the interior space of the holding body 5. The cross arm aperture 8 allows a first holding body 2*a* and a second holding body 2*b* to be slideably attached to a cross arm 15 (as illustrated in FIGS. 4 and 5) to allow a user to position and mount two hanging hooks on a wall simultaneously. Multiple holding bodies 2 may be slideably attached to a cross arm 15 to mount multiple spaced apart hooks on a wall. For example, when hanging a plurality of pictures in a level row equally spaced apart from each other.

With reference to FIGS. 4 and 5, a picture hanging hook positioning and mounting device 1 of the present invention having a first holding body 2*a* and second holding body 2*b* attached to a cross arm 15 is illustrated. The first holding body 2*a* and second holding body 2*b* may each comprise a cross arm aperture 8. A locking means 16, such as a threaded aperture 17 and bolt 18, is preferably located on the holding body 2 to allow a user to lock the holding body 2 in a desired position on the cross arm 15.

The cross arm 15 preferably comprises a rear surface 19 and a front surface 20 on which a groove 21 may be located that engages the locking means 16. At least one bubble level 22 is located on the front surface 20 of the cross arm 15 to ensure that a hanging hook being positioned in the first holding body 2*a* is level with a hanging hook being simultaneously positioned in the second holding body 2*b*. More than one bubble level 22 may be provided to determine plum and forty-five degree angles.

The cross arm 15 is preferably clear and has ruler markings 23 located thereon for measuring the distance between the first holding body 2*a* and the second holding body 2*b*. A vertical measuring means may also be incorporated into the picture hanging hook positioning and mounting device 1, such as a tape measure, laser or other equivalent means, that measures a distance between the floor and the picture hanging hook positioning and mounting device 1 to ensure the one or more hanging hooks being mounted on a wall are mounted at a correct height.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A picture hanging hook positioning and mounting device comprising:

a first holding body having a substantially planar rear panel, a front panel spaced a predetermined distance from the rear panel, two side panels, a top panel and a bottom panel;

at least one recessed slot located on the top panel of the first holding body;

a second holding body having a substantially planar rear panel, a front panel spaced a predetermined distance from the rear panel, two side panels, a top panel and a bottom panel;

at least one recessed slot located on the top panel of the second holding body; and said first holding body and second holding body each being slideably attached to a cross arm;

said at least one recessed slot located on the first holding body comprises a plurality of recessed slots located on the top panel thereof; and said at least one recessed slot located on the second holding body comprises a plurality of recessed slots located on the top panel thereof.

2. The picture hanging hook positioning and mounting device of claim 1 wherein:

said at least one recessed slot located on the top panel of the first holding body is rectangular-shaped; and said at least one recessed slot located on the top panel of the second holding body is rectangular-shaped.

3. A picture hanging hook positioning and mounting device comprising:

a first holding body having a substantially planar rear panel, a front panel spaced a predetermined distance from the rear panel, two side panels, a top panel and a bottom panel;

at least one recessed slot located on the top panel of the first holding body;

a second holding body having a substantially planar rear panel, a front panel spaced a predetermined distance from the rear panel, two side panels, a top panel and a bottom panel;

at least one recessed slot located on the top panel of the second holding body; and said first holding body and second holding body each being slideably attached to a cross arm;

said at least one recessed slot located on the first holding body comprise a first recessed slot then one or more progressively smaller recessed slots; and said at least one recessed slot located on the second holding body comprise a first recessed slot and one or more progressively smaller recessed slots.

4. A picture hanging hook positioning and mounting device comprising:

a first holding body having a substantially planar rear panel, a front panel spaced a predetermined distance from the rear panel, two side panels, a top panel and a bottom panel;

at least one recessed slot located on the top panel of the first holding body;

a second holding body having a substantially planar rear panel, a front panel spaced a predetermined distance from the rear panel, two side panels, a top panel and a bottom panel;

at least one recessed slot located on the top panel of the second holding body; and said first holding body and second holding body each being slideably attached to a cross arm;

at least one magnet located between the at least one recessed slot and the rear panel of the first holding body; and at least one magnet located between the at least one recessed slot and the rear panel of the second holding body.

5. A picture hanging hook positioning and mounting device comprising:

a first holding body having a substantially planar rear panel, a front panel spaced a predetermined distance from the rear panel, two side panels, a top panel and a bottom panel;

at least one recessed slot located on the top panel of the first holding body;

a second holding body having a substantially planar rear panel, a front panel spaced a predetermined distance from the rear panel, two side panels, a top panel and a bottom panel;

at least one recessed slot located on the top panel of the second holding body; and said first holding body and second holding body each being slideably attached to a cross arm;

said first holding body further comprises a cross arm aperture extending through the side panels of the first holding body and the interior space of the first holding body; and said second holding body further comprises a cross arm aperture extending through the side panels of the second holding body and the interior space of the second holding body.

6. A picture hanging hook positioning and mounting device comprising:

a first holding body having a substantially planar rear panel, a front panel spaced a predetermined distance from the rear panel, two side panels, a top panel and a bottom panel;

at least one recessed slot located on the top panel of the first holding body;

a second holding body having a substantially planar rear panel, a front panel spaced a predetermined distance from the rear panel, two side panels, a top panel and a bottom panel;

at least one recessed slot located on the top panel of the second holding body;

said first holding body and second holding body each being slideably attached to a cross arm;

said at least one recessed slot located on the top panel of the first holding body is rectangular-shaped; and said at least one recessed slot located on the top panel of the second holding body is rectangular-shaped.

7. The picture hanging hook positioning and mounting device of claim 6 wherein:

said at least one recessed slot located on the first holding body comprises a plurality of recessed slots located on the top panel thereof; and said at least one recessed slot located on the second holding body comprises a plurality of recessed slots located on the top panel thereof.

8. The picture hanging hook positioning and mounting device of claim 6 wherein:

said plurality of recessed slots located on the first holding body comprise a first recessed slot and one or more progressively smaller recessed slots; and said plurality of recessed slots located on the second holding body comprise a first recessed slot and one or more progressively smaller recessed slots.

9. The picture hanging hook positioning and mounting device of claim 6 further comprising:

at least one magnet located between the at least one recessed slot and the rear panel of the first holding body; and at least one magnet located between the at least one recessed slot and the rear panel of the first holding body.

10. The picture hanging hook positioning and mounting device of claim 6 wherein:

said first holding body further comprises a cross arm aperture extending through the side panels of the first holding body and the interior space of the first holding body; and said second holding body further comprises a cross arm aperture extending through the side panels of the second holding body and the interior space of the second holding body.

* * * * *